US006059049A

United States Patent [19]

Lin

[11] Patent Number: 6,059,049

[45] Date of Patent: May 9, 2000

[54] AIR CYLINDER APPARATUS FOR A PNEUMATICALLY DRIVEN POWER TOOL

[76] Inventor: Chen-Yang Lin, No. 51-2, Lane 490, Chung-Cheng S. Rd, Yang-Kang City, Tainan Hsien, Taiwan

[21] Appl. No.: 09/383,071

[22] Filed: Aug. 26, 1999

[30] Foreign Application Priority Data

Mar. 9, 1999 [TW] Taiwan ..... 88203535

[51] Int. Cl.[7] ..... B25D 15/00; B25B 19/00

[52] U.S. Cl. ..... 173/93.5; 173/93; 173/218

[58] Field of Search ..... 173/93, 93.5, 93.6, 173/176, 109, 218

[56] References Cited

U.S. PATENT DOCUMENTS

| | | | |
|---|---|---|---|
| 4,836,296 | 6/1989 | Biek | 173/93.5 |
| 5,611,404 | 3/1997 | Biek et al. | 173/93.5 |
| 5,704,434 | 1/1998 | Schoeps | 173/218 |
| 5,836,401 | 11/1998 | Hsiu-Tsu | 173/93 |
| 5,954,141 | 9/1999 | Li et al. | 173/109 |

*Primary Examiner*—Scott A. Smith

*Attorney, Agent, or Firm*—Finnegan, Henderson, Farabow, Garrett & Dunner, L.L.P.

[57] ABSTRACT

An air cylinder apparatus for a pneumatically driven power tool includes a unitary outer cylinder member, which has a bearing plate and a hollow cylindrical wall. A cylindrical chamber is formed eccentrically in the cylindrical wall. A bearing member is mounted removably on an end of the cylindrical wall. A cylindrical inner wall member is press fitted within the cylindrical wall of the outer cylinder member, and has two spaced adjacent axial sides that define an open-ended axial slot therebetween. The inner wall member can be compressed in a radial direction for removal from the outer cylinder member. Because the outer cylinder member is molded, the power tool can be manufactured easily and conveniently.

5 Claims, 5 Drawing Sheets

AIR CYLINDER APPARATUS FOR A PNEUMATICALLY DRIVEN POWER TOOL

BACKGROUND OF THE INVENTION

1. Field of the Invention

This invention relates to a pneumatically driven power tool, more particularly to an air cylinder apparatus for a pneumatically driven power tool, which has a unitary outer cylinder member that can be manufactured easily and conveniently.

2. Description of the Related Art

Referring to FIG. 1, a conventional air cylinder apparatus 1 for a pneumatically driven power tool is shown to include a cylindrical wall 11, a front bearing member 12 and a rear bearing member 13. A rotor 10 is disposed within a cylindrical chamber 111 that is formed eccentrically within the cylinder wall 11, and is journalled on the front and rear bearing members 12, 13. The cylindrical wall 11 has forward and reverse guideways 112, and two exhaust ports 113. Each of the front and rear bearing members 12, 13 is provided with a bearing 15. The rotor 20 has a rotating shaft, which extends through bearing holes 121, 131 in the front and rear bearing members 12, 13. The rear bearing member 13 has two aligned semi-circular slots 132 that extend around the bearing hole 131, and two air ports 133, which guide air into the chamber 111 for rotating the rotor 10. The front bearing member 12 has two aligned semi-circular slots (not shown) that are formed in an inner side surface thereof. Because the cylindrical wall 11 is bored by a lathe to form the chamber 111, it is time-consuming to manufacture the apparatus 1, thereby increasing the manufacturing costs.

SUMMARY OF THE INVENTION

The object of this invention is to provide an air cylinder apparatus for a pneumatically driven power tool with a unitary outer cylinder member, which can be formed easily and conveniently by molding.

According to this invention, an air cylinder apparatus for a pneumatically driven power tool includes a unitary outer cylinder member, which has a bearing plate and a hollow cylindrical wall. A cylindrical chamber is formed eccentrically in the cylindrical wall. A bearing member is mounted removably on an end of the cylindrical wall. A cylindrical inner wall member is press fitted within the cylindrical wall of the outer cylinder member, and has two spaced adjacent axial sides that define an open-ended axial slot therebetween. The inner wall member can be compressed in a radial direction for removal from the outer cylinder member. Because the outer cylinder member is molded, the power tool can be manufactured easily and conveniently.

BRIEF DESCRIPTION OF THE DRAWINGS

These and other features and advantages of the invention will become apparent in the following detailed description of the preferred embodiments, with reference to the accompanying drawings, in which.

DETAILED DESCRIPTION OF THE PREFERRED EMBODIMENTS

Figure 2:
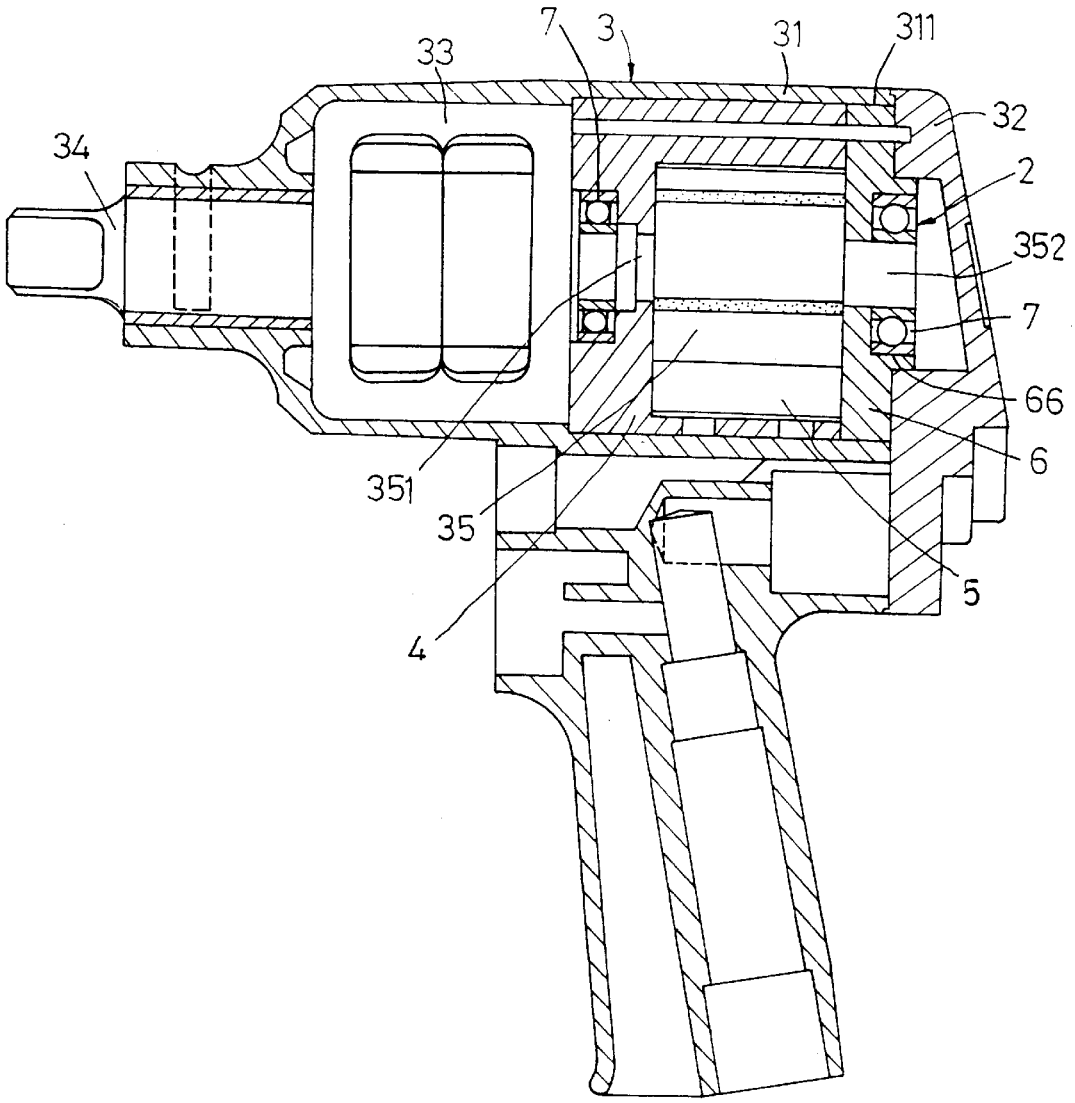
FIG. 2 is a sectional view of a pneumatically driven power tool that is used with a first preferred embodiment of an air cylinder apparatus according to this invention.
Figure 3:
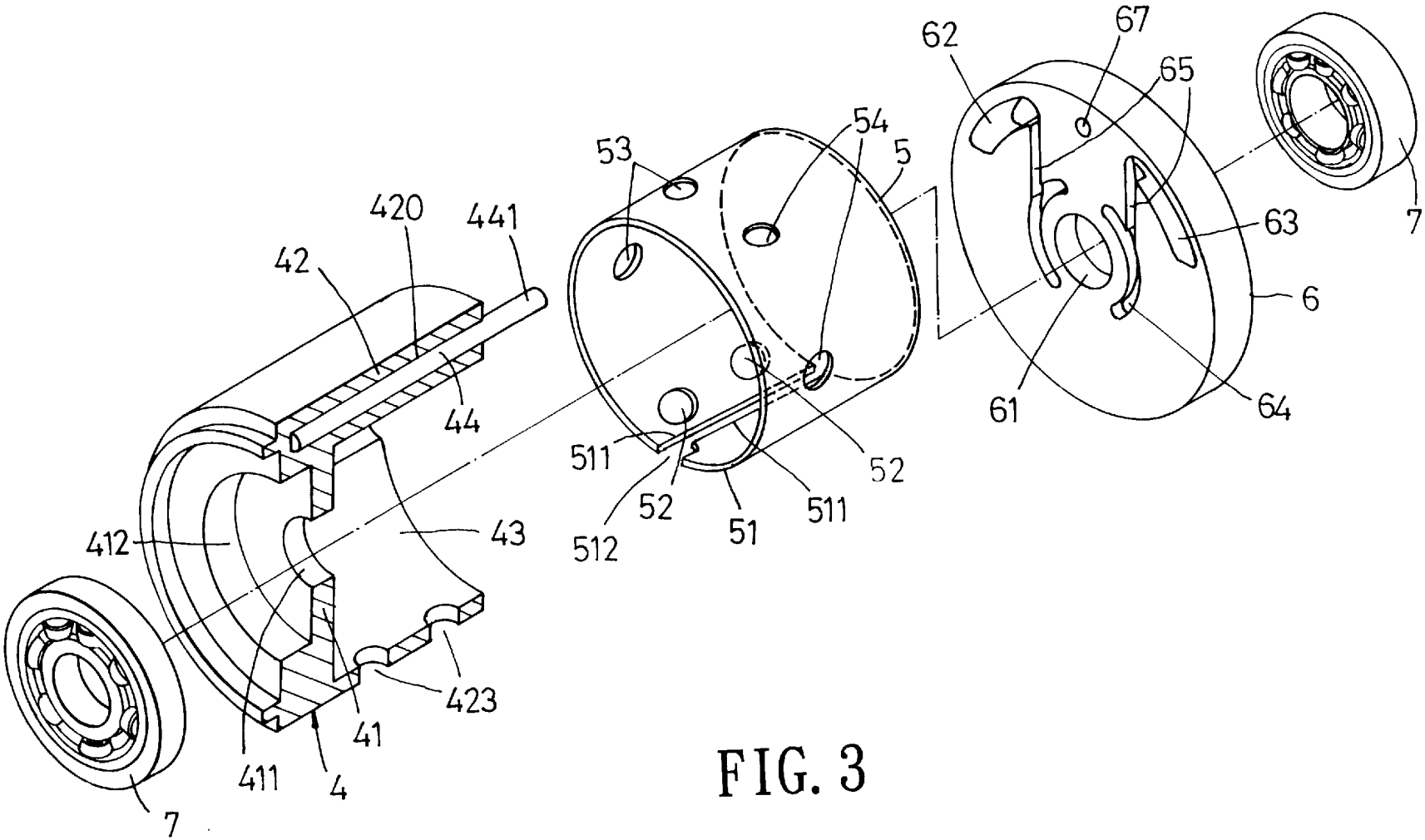
FIG. 3 is an exploded perspective view of the first preferred embodiment.

Referring to FIGS. 2 and 3, a first preferred embodiment of an air cylinder apparatus 2 according to this invention is shown to be mounted within a pneumatically driven power tool 3. The tool 3 has an outer housing 31, a rear cover 32, an impact mechanism 33, a tool head 34, and a rotor 35, which is journalled within a chamber 311 in the outer housing 31 and which is provided with a fixed front shaft 351 and a fixed rear shaft 352 that are coaxial with each other. The apparatus 2 is disposed between the impact mechanism 33 and the rear cover 32, and includes a unitary outer cylinder member 4, a cylindrical inner wall member 5, a rear bearing member 6, and two bearings 7. The rear cover 32 is mounted removably on the outer housing 31 in a known manner.

Figure 4:
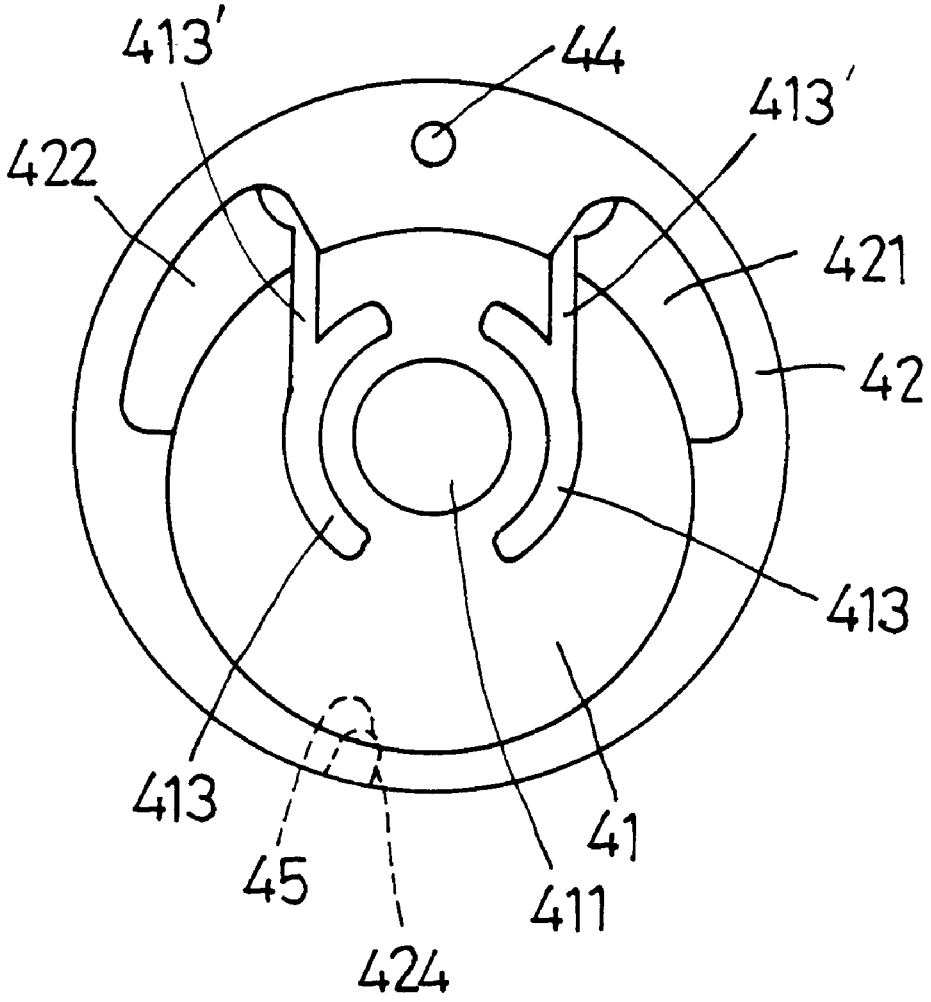
FIG. 4 is a rear side view of the first preferred embodiment.

Referring to FIGS. 3 and 4, the outer cylinder member 4 is molded from a plastic material or metal, such as aluminum, and has a front bearing plate 41, and a hollow cylindrical wall 42 that extends rearward from the front bearing plate 41 and that defines a cylindrical chamber 43 therein. The cylindrical chamber 43 is eccentric from a front bearing hole 411, which is formed in a central portion of the front bearing plate 41 and which is adapted to permit extension of the front shaft 351 (see FIG. 2) of the rotor 35 (see FIG. 2) therethrough. The cylindrical wall 42 has a rear end surface that is formed with an axially extending blind hole 420, in which a positioning rod 44 is press fitted. The positioning rod 44 has a rear end portion 441 that is inserted into a positioning hole 67 in the rear bearing member 6, thereby positioning the rear bearing member 6 relative to the outer cylinder member 4. A steel ball 45 is fixed within a ball hole 424 in an inner surface of the cylindrical wall 42. The outer cylinder member 4 is formed with a bearing accommodating recess 412 in a front end surface thereof for receiving the front bearing 7. The front bearing plate 41 has a rear or inner side surface, which is formed with two aligned semi-circular slots 413 that extend around the front bearing hole 411, and two guiding slots 413', which are communicated respectively with the semi-circular slots 413. The cylindrical wall 42 has an inner surface, which is formed with an axially extending forward guideway 421, an axially extending reverse guideway 422, and two exhaust ports 423. The semi-circular slots 413 are communicated with the forward guideway 421 and the reverse guideway 422, respectively.

The inner wall member 5 is formed from a steel plate, which is press fitted within the cylindrical wall 42 of the outer cylinder member 4, and has an open-ended axial slot 51 that is defined between two spaced adjacent sides 511 of the inner wall member 5. Accordingly, the inner wall member 5 can be compressed in a radial direction for removal from the outer cylinder member 4. One of the sides 51 has a notch 512, which is formed in an end portion thereof and which engages the ball 45 of the outer cylinder member 4, thereby positioning the inner wall member 5 within the outer cylinder member 4. The inner wall member 5 further has two air ports 52 that are communicated respectively with the exhaust port 423 in the outer cylinder member 4, two forward inlet ports 53 that are communicated with the forward guideway 421 in the outer cylinder member 4, and two reverse inlet ports 54 that are communicated with the reverse guideway 422 in the outer cylinder member 4.

The rear bearing member 6 is clamped between the outer cylinder member 4 and the rear cover 32 (see FIG. 2), and has a rear bearing hole 61 that is aligned with the front bearing hole 411 in the front bearing plate 41, a forward passageway 62 and a reverse passageway 63 that are formed in a peripheral portion of the rear bearing member 6 and that guide air into the inner wall member 5. A front or inner side surface of the rear bearing member 6 is formed with two aligned semi-circular slots 64 that extend around the rear bearing hole 61, and two guiding slots 65, which are communicated respectively with the semi-circular slots 64 and which are communicated respectively with the forward passageway 421 and the reverse passageway 422. A bearing accommodating recess 66 (see FIG. 2) is formed in a rear end surface of the rear bearing member 6 for receiving the rear bearing 7.

Figure 1:
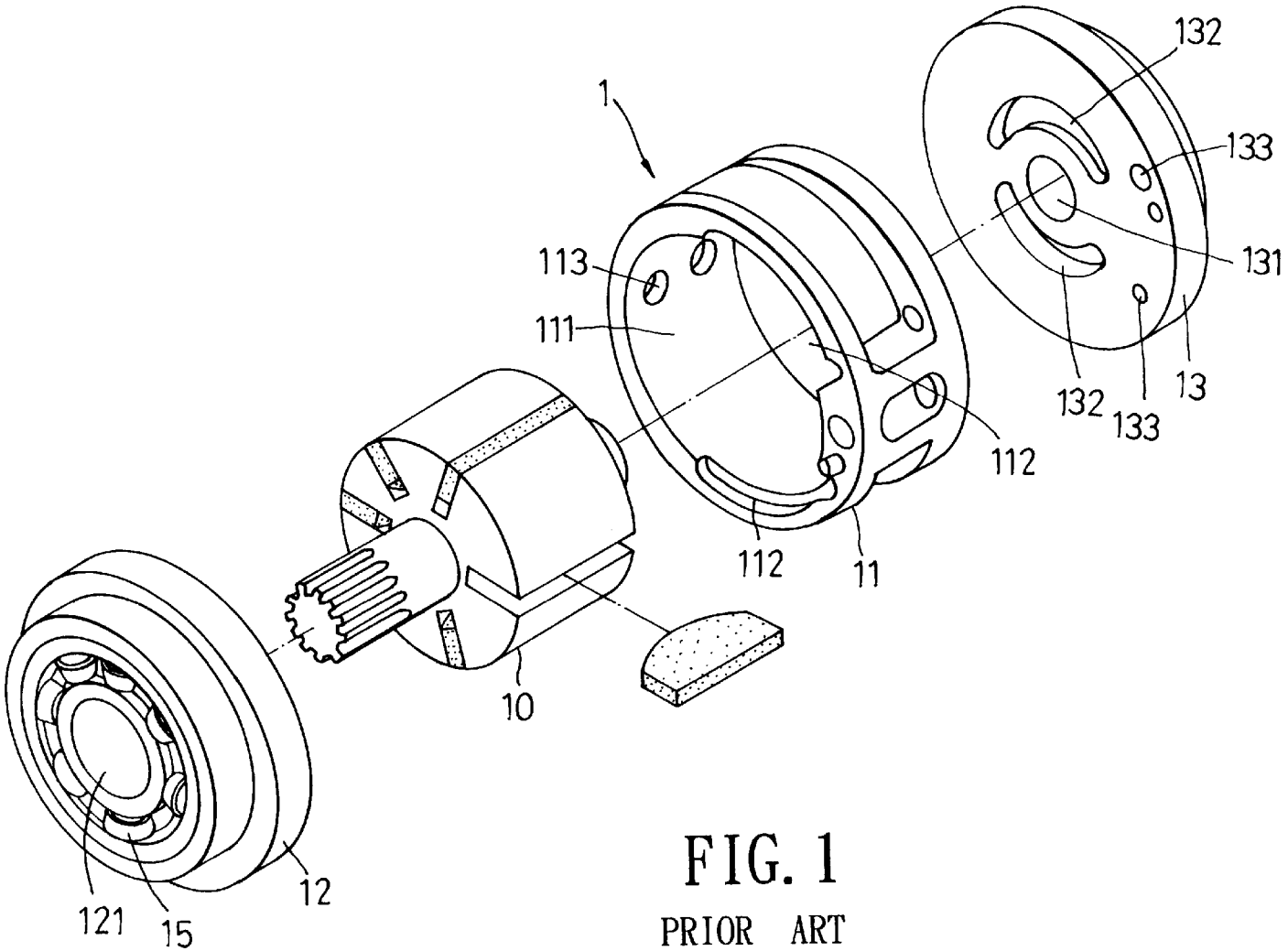
FIG. 1 PRIOR ART
FIG. 1 is an exploded perspective view of a conventional air cylinder apparatus for a pneumatically driven power tool.

The air cylinder apparatus of this invention has the following advantages:

1. The apparatus consists of less parts, as compared to the conventional apparatus shown in FIG. 1.

2. The inner wall member 5 can be positioned easily within the outer cylinder member 4 by engaging the ball 45 within the notch 512.

3. The rear bearing member 6 can be positioned easily relative to the outer cylinder member 4 by inserting the positioning rod 44 into the positioning hole 67.

4. It is efficient to mold the unitary outer cylinder member 4.

As such, the apparatus of this invention can be manufactured easily and conveniently.

Furthermore, the inner wall member 5 can be replaced easily with a new one.

Figure 5:
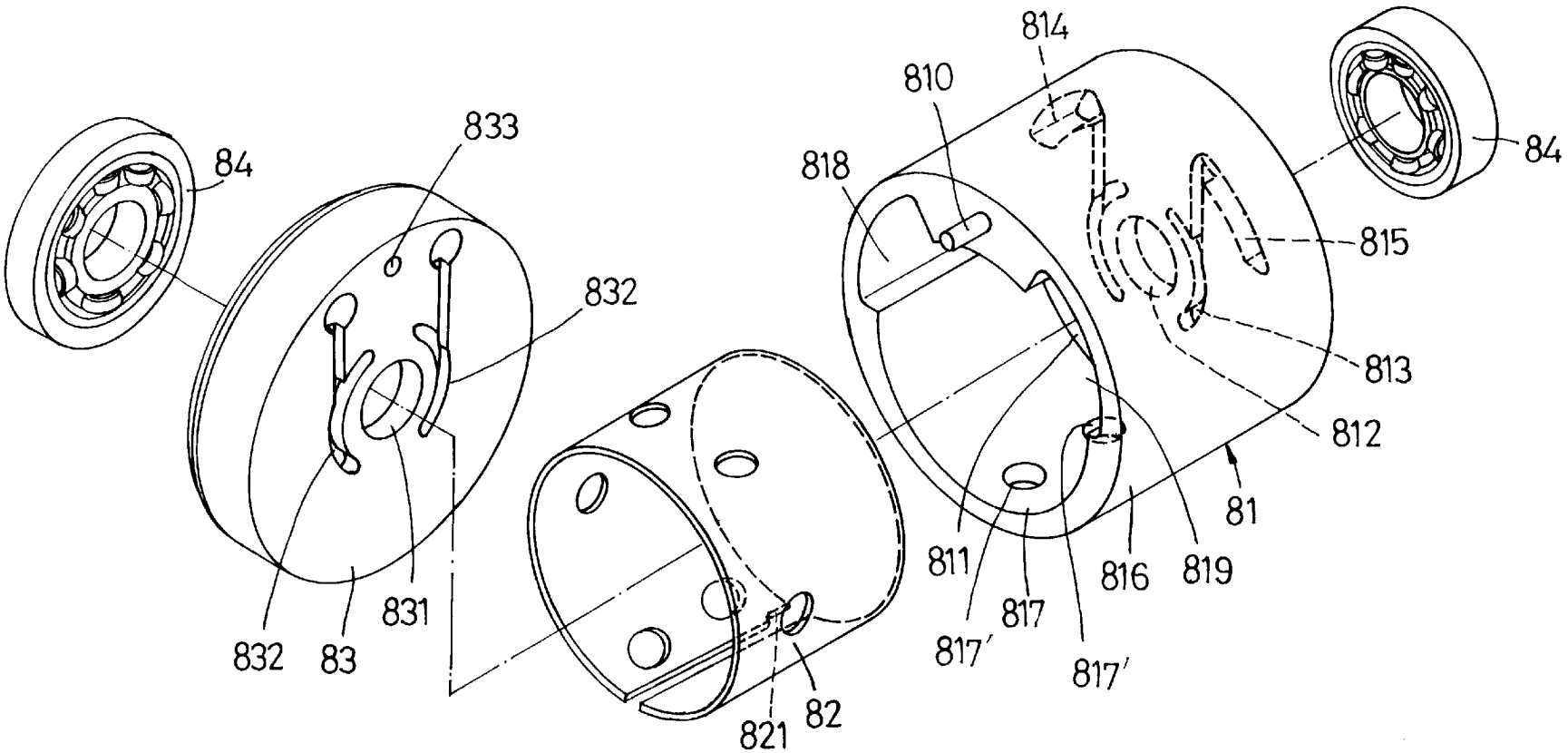
FIG. 5 is an exploded perspective view of a second preferred embodiment of an air cylinder apparatus according to this invention.

FIG. 5 shows a second preferred embodiment of this invention, which includes a unitary outer cylinder member 81, a cylindrical inner wall member 82, a front bearing member 83, and two bearings 84.

The outer cylinder member 81 includes a fixed positioning rod 810, a rear bearing plate 811, which has a rear rearing hole 812 that is formed in a central portion thereof, two semi-circular slots 813, a forward passageway 814 and a reverse passageway 815 that are formed in a peripheral portion of the rear bearing plate 811. A hollow cylindrical wall 816 extends forward from the rear bearing plate 811. A cylindrical chamber 817 is defined within the cylindrical wall 816, and is eccentric from the rear bearing hole 812 in the rear bearing plate 811. The cylindrical wall 816 has two exhaust ports 817', an axially extending forward guideway 818, and an axially extending reverse guideway 819.

The inner wall member 82 is press fitted within the cylindrical wall 816 of the outer cylinder member 81, and is similar to the inner wall member 5 (see FIG. 3) of the first embodiment in construction except that the position of a notch 821 in the inner wall member 82 is different from that of the notch 512 (see FIG. 3) of the first embodiment.

The front bearing member 83 is mounted removably on a front end of the cylindrical wall 816 of the outer cylinder member 81, and has a front bearing hole 831 that is aligned with the rear bearing hole 812 in the rear bearing plate 811, two semi-circular slots 832, and a positioning hole 833 that engages the positioning rod 810.

The bearings 84 are disposed respectively on the outer cylinder member 81 and the front bearing member 83.

With this invention thus explained, it is apparent that numerous modifications and variations can be made without departing from the spirit and scope of this invention. It is therefore intended that this invention be limited only as indicated by the appended claims.

I claim:

1. An air cylinder apparatus for a pneumatically driven power tool, the power tool having an outer housing and a rotor, which is journalled within the outer housing and which is provided with a fixed front shaft and a fixed rear shaft that are coaxial with each other, said air cylinder apparatus comprising:

a unitary outer cylinder member having a front end surface with a bearing accommodating recess, a front bearing plate, and a hollow cylindrical wall, which extends rearward from said front bearing plate and which defines a cylindrical chamber therein, said front bearing plate having a front bearing hole that is formed through a central portion thereof and that is adapted to permit extension of the front shaft of the rotor therethrough, said cylindrical chamber being eccentric from said front bearing hole, said cylindrical wall having an inner surface, which is formed with at least one exhaust port, an axially extending forward guideway, and an axially extending reverse guideway;

a cylindrical inner wall member press fitted within said cylindrical wall of said outer cylinder member and having at least one air port that is formed therethrough and that is communicated with said exhaust port in said outer cylinder member, a forward inlet port that is communicated with said forward guideway in said outer cylinder member, a reverse inlet port that is communicated with said reverse guideway in said outer cylinder member, and two spaced adjacent axial sides that define an open-ended axial slot therebetween, so that said inner wall member can be compressed in a radial direction, thereby removing said inner wall member from said outer cylinder member;

a rear bearing member mounted removably on a rear end of said cylindrical wall of said outer cylinder member and having a rear end surface with a bearing accommodating recess, a rear bearing hole that is aligned with said front bearing hole in said front bearing plate and that is adapted to permit extension of the rear shaft of the rotor therethrough, a forward passageway and a reverse passageway that guide air into said inner wall member; and two bearings disposed respectively within said bearing accommodating recesses in said outer cylinder member and said rear bearing member and adapted to journal the front and rear shafts of the rotor thereon.

2. An air cylinder apparatus as claimed in claim 1, wherein said rear bearing member has a positioning hole formed therein, said outer cylinder member including a rear end surface that is formed with an axially extending blind hole, and a positioning rod, which is press fitted within said blind hole and which has a rear end portion that extends from said blind hole to engage said positioning hole in said rear bearing member, thereby positioning said rear bearing member relative to said outer cylinder member.

3. An air cylinder apparatus as claimed in claim 1, wherein one of said axial sides of said inner wall member has a notch formed in an end portion thereof, said outer cylinder member including a ball that is fixed in said cylindrical wall and that engages said notch in said inner wall member, thereby positioning said inner wall member within said outer cylinder member.

4. An air cylinder apparatus as claimed in claim 1, wherein each of said front bearing plate and said rear bearing member has an inner side surface, which is formed with two aligned semi-circular slots that extend around a corresponding one of said front and rear bearing holes, and two connecting slots, each of which is communicated with a corresponding one of said semi-circular slots and a corresponding one of said forward guideway and said reverse guideway in said outer cylinder member.

5. An air cylinder apparatus for a pneumatically driven power tool, the power tool having an outer housing and a rotor, which is journalled within the outer housing and which is provided with a fixed front shaft and a fixed rear shaft that are coaxial with each other, said air cylinder apparatus comprising:

a unitary outer cylinder member having a rear bearing plate and a hollow cylindrical wall, which extends forward from said rear bearing plate and which defines a cylindrical chamber therein, said rear bearing plate having a rear bearing hole that is formed in a central portion thereof and that is adapted to permit extension of the rear shaft of the rotor therethrough, a forward passageway and a reverse passageway, which are formed in a peripheral portion of said rear bearing plate, said cylindrical chamber being eccentric from said rear bearing hole in said rear bearing plate, said cylindrical wall having at least one exhaust port, an axially extending forward guideway, and an axially extending reverse guideway;

a cylindrical inner wall member press fitted within said cylindrical wall of said outer cylinder member and having at least one air port that is formed therethrough and that is communicated with said exhaust port in said outer cylinder member, a forward inlet port that is communicated with said forward guideway in said outer cylinder member, a reverse inlet port that is communicated with said reverse guideway in said outer cylinder member, and two spaced adjacent axial sides that define an open-ended axial slot therebetween, so that said inner wall member can be compressed in a radial direction, thereby removing said inner wall member from said outer cylinder member;

a front bearing member mounted removably on a front end of said cylindrical wall of said outer cylinder member and having a front bearing hole that is aligned with said rear bearing hole in said rear bearing plate and that is adapted to permit extension of the front shaft of the rotor therethrough; and two bearings disposed resepctively on said outer cylinder member and said front bearing member so as to journal the front and rear shafts of the rotor thereon.

* * * * *